US005258103A

United States Patent [19]

Endoh et al.

[11] Patent Number: 5,258,103

[45] Date of Patent: Nov. 2, 1993

[54] PROCESS FOR PRODUCING TERBIUM ALLOY OR TERBIUM METAL

[75] Inventors: Hozumi Endoh; Haruo Kunitomo, both of Kitakyushu; Nobuo Sugimura, Tagawa, all of Japan

[73] Assignee: Mitsubishi Kasei Corporation, Chiyoda, Japan

[21] Appl. No.: 821,737

[22] Filed: Jan. 16, 1992

[30] Foreign Application Priority Data

Jan. 17, 1991 [JP] Japan ..... 3-3982
Apr. 25, 1991 [JP] Japan ..... 3-95203

[51] Int. Cl.[5] ..... C25C 3/34

[52] U.S. Cl. ..... 204/71; 204/64 R; 205/230; 205/231

[58] Field of Search ..... 205/230, 231, 232; 204/64 R, 71

[56] References Cited

U.S. PATENT DOCUMENTS 3,729,397 4/1973 Goldsmith et al. ..... 204/64 R
4,783,245 11/1988 Nakamura et al. ..... 204/71

FOREIGN PATENT DOCUMENTS 62-224692 10/1987 Japan .

OTHER PUBLICATIONS

Hackh's Chemical Dictionary, Fourth Edition, McGraw-Hill Book Co., New York, 1969, p. 666.

*Primary Examiner*—John Niebling
*Assistant Examiner*—William T. Leader
*Attorney, Agent, or Firm*—David G. Conlin; George W. Neuner

[57] ABSTRACT

A process for producing a terbium alloy or terbium metal in which terbium(III) oxide substantially free from terbium(IV) oxide as the starting substance is subjected to electrolytic reduction in a molten salt electrolysis bath is described. According to the process of the present invention, a terbium alloy or terbium metal can be easily produced at a high yield.

16 Claims, No Drawings

PROCESS FOR PRODUCING TERBIUM ALLOY OR TERBIUM METAL

BACKGROUND OF THE INVENTION

The present invention relates to a process for producing a terbium alloy or terbium metal and, more in particular, relates to a process for continuously producing a terbium alloy or terbium metal with high terbium content and low content of impurities suitable to a starting material, e.g., for a terbium-iron-cobalt system sputtering target.

A process for producing alloys by electrolysis of oxides of rare earth elements such as neodium, samarium, gadolinium, cerium, lanthanum, praceodymium, yttrium and europium have been known. However, there has been known no practical process of electrolysis of terbium oxides. It has been found by the present inventors that no satisfactory extent of reduction can be attained in the conventional electrolysis of a usual terbium oxide ($Tb_4O_7$).

Although electrolysis of fluorides of terbium has been conducted to produce a terbium alloy or terbium metal (Japanese Patent Application Laid-Open (KOKAI) No. 62-224692(1987)), this process is not advantageous for industrial mass production since it requires, in this process, a superfluous step of fluorination of the terbium oxides. It has therefore been thought that a process which enables to obtain a sufficient amount of terbium alloys or terbium metal by a direct electrolysis of terbium oxides is industrially advantageous and desirable

SUMMARY OF THE INVENTION

It is, accordingly, an object of the present invention to provide a process for producing terbium alloys or terbium metal in which terbium alloys or terbium metal can be produced industrially advantageously and in large amount by a molten salt electrolysis using terbium oxide as the starting material.

Terbium oxides are generally represented by a chemical formula $Tb_4O_7$ in which tetravalent terbium and trivalent terbium are contained in a molar ratio of 2:1. According to the study of the present inventors, it has been found that when $Tb_4O_7$ is supplied as the starting material for electrolysis to an electrolysis bath, existence of tetravalent terbium inhibits metal terbium from depositing on a cathode or forming an alloy with the metal constituting the cathode. In view of the above, the present inventors have found after the further studies that the produced amount of terbium alloys or terbium metal can be remarkably increased by converting the terbium oxide ($Tb_4O_7$) into $Tb_2O_3$ by reduction, that is, reducing the tetravalent terbium to trivalent terbium prior to electrolysis and then subjecting the reduced oxide ($Tb_2O_3$) to electrolytic reduction. The present invention has been accomplished based on this finding. The characteristic feature of the present invention resides in a process for producing a terbium alloy or terbium metal which comprises subjecting terbium(III) oxide substantially free from terbium(IV) oxide to electrolytic reduction in a molten salt electrolysis bath mainly comprising lithium fluoride and/or terbium(III) fluoride.

DETAILED DESCRIPTION OF THE INVENTION

The starting terbium oxide to be reduced is substantially free from tetravalent terbium and, usually, a terbium oxide in which substantially all the terbium present therein is trivalent is used. More specifically, the content of terbium(IV) oxide in the terbium oxide is preferred to be less than 5% by weight. For converting terbium oxide ($Tb_4O_7$) into $Tb_2O_3$ prior to electrolytic reduction, it is convenient to subject $Tb_4O_7$ to reduction in vacuum, in an atmosphere of an inert gas such as argon gas or in an atmosphere of a reducing gas such as hydrogen and carbon monoxide. The reduction temperature is preferably not lower than 540° C., more preferably not lower than 600° C. Reduction does not occur at a temperature below 540° C. Further, the time period required for the reduction can be shortened as the reduction temperature becomes higher. However, there is no more substantial difference in the required time period when the temperature goes higher than 1000° C. and, accordingly, there will be no merit in elevating the temperature higher. The thus obtained $Tb_2O_3$ is of a creamy or white color and stable at a room temperature.

In the process according to the present invention, a fluoride mixture containing terbium is preferably used as a molten salt electrolysis bath. As the fluoride mixture, a mixture comprising terbium(III) fluoride, lithium fluoride and an optional barium fluoride is preferred from a view point of preventing contamination with impurities, and is preferred a mixture comprising at least one of 0 to 100% by weight of terbium(III) fluoride and 0 to 100% by weight of lithium fluoride, and optional barium fluoride of up to 40% by weight, and is more preferred a mixture comprising 20 to 95% by weight of terbium(III) fluoride, 5 to 80% by weight of lithium fluoride and up to 40% by weight of barium fluoride.

In a case of producing a terbium alloy, a rod- or plate-like cathode comprising a metal capable of forming an alloy with terbium is used. A rod- or plate-like electrode comprising carbon molding product is usually used for an anode. The terbium(III) oxide is subjected to electrolytic reduction in a molten salt electrolysis bath, terbium formed is deposited on the cathode and, at the same time, an alloy of terbium and the metal constituting the cathode is formed to obtain an intended terbium alloy.

As the alloying element to form an alloy with terbium, there can be usually mentioned, for example, iron and cobalt. In the process of the present invention, a terbium alloy is formed on a cathode comprising the above-mentioned metal in a liquid state and then goes downward as liquid droplets due to the difference in the specific gravity between the alloy and the electrolysis bath. The terbium alloy formed is stored as a liquid layer in a receiver disposed below the cathode and having an opening in the electrolysis bath. A receiver made from a sparingly fusible metal such as molybdenum and tungsten is used.

Since the impurities in the cathode are readily mixed into the liquid droplets of a terbium alloy, the cathode is preferred to be made of material with less impurity, for example in case of iron, an electrolytic iron.

The electrolysis temperature is properly selected depending on the kind of and the melting point of the terbium alloy to be formed. Theoretically, an alloy of a specific composition can be obtained directly by electrolysis at the melting point of the alloy having the above-mentioned composition, but such an alloy having a predetermined composition can be usually obtained by obtaining an alloy through electrolysis at a lower temperature and then adding to the obtained alloy a required amount of an alloying element, melting and forming the intended alloy. Generally, if the temperature of the electrolysis bath (the electrolysis temperature) is excessively high, there is a possibility that impurities, for example, from the electrolysis vessel, may contaminate the alloy to be produced. Further, if the temperature of the electrolytic bath is excessively low, the deposited terbium metal and the metal of the cathode are not sufficiently alloyed to cause short circuit between the anode and the cathode due to the deposition of solid terbium metal, thereby making it difficult to continue electrolysis. In view of the above, it is preferred to conduct electrolysis, for example, at a temperature from 710° to 1000° C. in case of a terbium-cobalt alloy and 850° to 1200° C., preferably, 860° to 1000° C. in case of a terbium-iron alloy, because the terbium alloys can be easily obtained by using a usual simple apparatus.

The content of terbium in the terbium alloy produced by the process according to the present invention is dependent on the electrolysis temperature and usually not less than 50% by weight. As a specific example of the alloy, there can be mentioned a terbium-iron alloy comprising 65 to 88% by weight of terbium and 35 to 12% by weight of iron, particularly, a terbium-iron alloy comprising 80 to 88% by weight of terbium and 20 to 12% by weight of iron.

In case of producing terbium metal by the process according to the present invention, a solid bar- or plate-like solid electrode comprising an electroconductive substance not alloying with terbium is used as a cathode. Usually, graphite is preferred as the electroconductive substance. For the anode, a bar- or plate-like graphite is used usually. Terbium(III) oxide is subjected to electrolytic reduction in a molten salt electrolysis bath to deposit terbium on the cathode. The terbium metal is then collected by scraping off from the cathode.

There is no particular restriction for the electrolysis temperature so long as it is higher than the melting point of the fluoride mixture described above However, too high temperature is not preferred since it shortens the working life of the electrolysis apparatus. On the contrary, a low temperature near the melting point is not preferred because no high electrolysis efficiency can be expected due to a low solubility of the terbium(III) oxide in the molten salt electrolysis bath.

In the present process for producing terbium alloys or terbium metal, the current density over the front surface of the anode is preferably within a range from 0.05 to 4.0 A/cm$^2$, more preferably from 0.1 to 3.0 A/cm$^2$. The productivity is worsened if the current density is low, whereas abnormality is liable to occur at the surface of the anode if the current density is excessively high. The current density over the front surface of the cathode may be preferably selected from a wide range from 0.50 to 80 A/cm$^2$, however, a narrower range of 1.0 to 30 A/cm$^2$ is more preferred in view of making the change in the electrolytic voltage smaller to facilitate the operation.

In the process according to the present invention, the production efficiency of terbium alloy or terbium metal can be improved by stirring the electrolysis bath It is considered that the terbium(III) oxide sedimented at the bottom of the bath is diffused into the bath to promote the dissolution thereof into the bath and, therefore, the yield of the terbium alloy or terbium metal can be increased. As the stirring method, stirring by a stirring blade or stirring by blowing an inert gas through the bath may be adopted. In the case of using the stirring blade, the blade is preferred to be made of a high melting point material of an alloying element of the intended alloy, for example in the case where terbium-iron alloy is intended, iron and, in particular, electrolytic iron with less impurity is preferable. The rotational speed of the stirring blade is usually within a range from 30 to 600 r.p.m.

As a gas in the case of stirring by blowing the inert gas, an inert gas such as argon, helium and neon is usually used. The gas flow rate is preferably selected from a range of 0.2 to 30 l/min, preferably, 0.5 to 10 liter/min per one liter of the electrolysis bath. The inert gas is preferably introduced from the vicinity of the bottom of the electrolysis bath by means of single or plurality of nozzles so that the bath is sufficiently stirred.

The terbium alloy or the terbium metal can be obtained as described above. When a terbium-iron-cobalt sputtering target is intended, a terbium-iron alloy is first produced by using an iron cathode and then cobalt is incorporated into the alloy at a ratio to provide a predetermined composition and melted under heating to obtain a terbium-iron-cobalt alloy.

The present invention will now be described more in details referring to the following non-limitative examples.

EXAMPLE 1

Into a quartz tube was charged 176 g of $Tb_4O_7$, and the quartz tube was placed and heated at 950° C. for about 4 hour in an electric furnace in an argon gas atmosphere to subject $TbO_7$ to reduction treatment. Several minutes after starting the treatment, it was observed that the color of the oxide turned from brown to creamy color. Then, the quartz tube was cooled with water to obtain creamy colored powder. X-ray diffractiometry of the powder showed that not less than 99% of the powder was $Tb_2O_3$.

Then, 4400 g of a mixture comprising 80 mol % of lithium fluoride and 20 mol % of terbium(III) fluoride was charged into a graphite electrolysis vessel having 200 mm of inner diameter and 300 mm of depth, and the mixture was heated by a heater to about 900° C. and melted in an Ar gas atmosphere of about 1 atm. Into the molten electrolysis bath maintained at about 900° C., a graphite anode plate (50 mm width, 100 mm length and 10 mm thickness) and an electrolytic iron cathode plate (50 mm width, 100 mm length and 3 mm thickness) were inserted so that they were immersed by 50 mm in length respectively. Then, electrolysis was conducted at an electrolysis current of 20 A for 5 hours. Just before supplying the current to both the electrodes, was added 172 g of the oxide $Tb_2O_3$ into the electrolysis bath through the stainless steel tube. The current density for each of the anode and the cathode was 0.5 A/cm$^2$ respectively.

The Tb—Fe alloy collected from a molybdenum receiver disposed below the cathode weighed 150 g. It had a composition of 85% by weight of Tb and 15% by weight of Fe.

COMPARATIVE EXAMPLE 1

As the starting oxide, 176 g of $Tb_4O_7$ was used in place of $Tb_2O_3$. The electrolysis was conducted in the same conditions as those in Example 1 to obtain 10 g of Tb—Fe alloy having the same composition as that of the alloy obtained in Example 1.

EXAMPLE 2

Into a quartz tube was charged 176 g of $TbO_7$, and the quartz tube was placed and heated at 950° C. for about 4 hour in an electric furnace in an argon gas atmosphere to subject $TbO_7$ to reduction treatment. Several minutes after starting the treatment, it was observed that the color of the oxide turned from brown to white. Then, the quartz tube was cooled with water to obtain white powder. X-ray diffractiometry of the powder showed that not less than 99% of the powder was $Tb_2O_3$.

Then, 4400 g of a mixture comprising 80 mol % of lithium fluoride and 20 mol % of terbium(III) fluoride was charged into a graphite electrolysis vessel having 200 mm of inner diameter and 300 mm of depth, and the mixture was heated by a heater to about 900° C. and melted in an Ar gas atmosphere of about 1 atm. Into the molten electrolysis bath maintained at about 900° C., a graphite anode plate (50 mm width, 100 mm length and 10 mm thickness) and a graphite cathode plate (50 mm width, 100 mm length and 10 mm thickness) were inserted so that they were immersed by 50 mm in length respectively. Then, electrolysis was conducted at an electrolysis current of 25 A for 5 hours. Just before supplying the current to both the electrodes, was added 172 g of the oxide $Tb_2O_3$ into the electrolysis bath through the stainless steel tube.

The terbium metal collected from the cathode weighed 140 g.

COMPARATIVE EXAMPLE 2

The same procedures as in Example 2 were repeated except for using 176 g of $Tb_4O_7$ as the starting material in place of $Tb_2O_3$. No terbium metal was observed on the surface of the cathode and it could not be collected.

What is claimed is:

1. A process for producing a terbium alloy or terbium metal which comprises:

(a) immersing terbium (III) oxide that is substantially free from terbium (IV) oxide, in a molten salt electrolytic bath comprising a salt selected from the group consisting of lithium fluoride, terbium (III) fluoride and mixtures thereof and, thereafter, (b) passing an electrolysis current between an anode and a cathode in the resulting bath containing terbium (III) oxide to electrolytically reduce the terbium (III) oxide and deposit terbium on the cathode.

2. A process for producing a terbium alloy as defined in claim 1, wherein the cathode comprises a metal which is capable of forming an alloy with terbium.

3. A process for producing a terbium alloy as defined in claim 2, wherein the metal is iron or cobalt.

4. A process for producing a terbium alloy as defined in claim 3, wherein the metal is iron.

5. A process for producing a terbium alloy as defined in claim 4, wherein the electrolytic reduction is carried out at a temperature of the molten salt electrolysis bath from 850° to 1200° C.

6. A process for producing a terbium alloy as defined in claim 4, wherein the electrolytic reduction is carried out at a temperature of the molten salt electrolysis bath from 860° to 1000° C.

7. A process for producing a terbium alloy as defined in claim 4, wherein the terbium alloy has a composition of 65 to 88% by weight of terbium and 12 to 35% by weight of iron.

8. A process for producing a terbium alloy as defined in claim 4, wherein the terbium alloy has a composition of 80 to 88% by weight of terbium and 12 to 20% by weight of iron.

9. A process for producing terbium metal as defined in claim 1, wherein the cathode comprises a substance which does not form an alloy with terbium.

10. A process for producing terbium metal as defined in claim 9, wherein the substance is graphite.

11. A process as defined in claim 1, wherein the electrolysis bath is stirred during electrolytic reduction.

12. A process as defined in claim 1, wherein the molten salt electrolysis bath is stirred by a stirring blade at 30 to 600 r.p.m.

13. A process as defined in claim 1, wherein the electrolysis bath is stirred by blowing an inert gas through the molten salt electrolysis bath.

14. A process as defined in claim 1 wherein the molten salt electrolysis bath at step (a) of claim 1 comprises 20 to 95% terbium (III) fluoride, 5 to 80% by weight of lithium fluoride and 0 to 40% by weight of barium fluoride.

15. A process as defined in claim 1, wherein the terbium(III) oxide substantially free from terbium(IV) oxide is obtained by reducing terbium(IV) oxide or a mixture of terbium(III) oxide and terbium(IV) oxide in vacuum, in an inert gas atmosphere or in a reducing gas atmosphere at a temperature not lower than 540° C.

16. A process as defined in claim 1, wherein the electrolytic reduction is carried out under the conditions of a current density at the front surface of the anode of 0.05 to 4.0 $A/cm^2$, and a current density at the front surface of the cathode of 0.5 to 80 $A/cm^2$.

* * * * *